US005832334A

United States Patent [19]

Corn et al.

[11] Patent Number: 5,832,334

[45] Date of Patent: Nov. 3, 1998

[54] COLOR CONTROL SYSTEM FOR ELECTROGRAPHIC PRINTER

[75] Inventors: Stewart H. Corn, St. Paul; Brett A. Behnke, Hastings; Thomas A. Speckhard; Oyvind H. Iversen, both of Cottage Grove; Christopher J. Anton, Rosemount, all of Minn.; Kenneth W. Olson, River Falls, Wis.

[73] Assignee: Minnesota Mining and Manufacturing Company, St. Paul, Minn.

[21] Appl. No.: 856,570

[22] Filed: May 15, 1997

[51] Int. Cl.[6] ..... G03G 15/10; G03G 15/01; G03G 13/10

[52] U.S. Cl. ..... 399/57; 399/233; 399/238; 430/117

[58] Field of Search ..... 399/39, 57, 233, 399/237, 238, 120; 430/30, 45, 117, 119

[56] References Cited

U.S. PATENT DOCUMENTS

| | | | |
|---|---|---|---|
| 3,803,025 | 4/1974 | Dailey | 208/107 |
| 3,913,524 | 10/1975 | Fukushima et al. | 118/637 |
| 3,949,703 | 4/1976 | Smith et al. | 118/37 |
| 4,222,497 | 9/1980 | Lloyd et al. | 222/57 |
| 4,623,241 | 11/1986 | Buchan et al. | 355/10 |
| 4,860,924 | 8/1989 | Simms et al. | 222/56 |
| 5,083,165 | 1/1992 | Landa | 355/256 |
| 5,155,528 | 10/1992 | Morishige et al. | 355/208 |
| 5,208,637 | 5/1993 | Landa | 355/256 |
| 5,278,615 | 1/1994 | Landa | 355/256 |
| 5,319,421 | 6/1994 | West | 355/256 |
| 5,369,476 | 11/1994 | Bowers et al. | 355/256 |
| 5,396,316 | 3/1995 | Smith | 355/256 |
| 5,404,210 | 4/1995 | Day | 355/256 |
| 5,442,427 | 8/1995 | Day | 355/256 |
| 5,530,529 | 6/1996 | Henderson et al. | 355/246 |
| 5,623,715 | 4/1997 | Clark | 399/57 |

FOREIGN PATENT DOCUMENTS

| | | |
|---|---|---|
| 4-134365 | 5/1992 | Japan . |
| 4-368976 | 12/1992 | Japan . |
| WO 96/26469 | 8/1996 | WIPO . |

*Primary Examiner*—Joan H. Pendegrass
*Attorney, Agent, or Firm*—Gary L. Griswold; John H. Hornickel

[57] ABSTRACT

A system for substantially maintaining color density in liquid toners for electrographic printers is disclosed. The system includes means for substantially continuously supplying toner concentrate to a printer and means for substantially continuously withdrawing liquid toner from a printer into a waste flowstream. A method to achieve substantially consistent color density of liquid toner in a electrographic printing system is also disclosed.

15 Claims, 2 Drawing Sheets

COLOR CONTROL SYSTEM FOR ELECTROGRAPHIC PRINTER

FIELD OF INVENTION

This invention relates to apparatus and methods for controlling the color density of a printed image in electrographic printing processes using liquid toners.

BACKGROUND OF INVENTION

Electrographic printing processes can use dry or liquid toners. Electrographic printing processes can employ either (a) electrophotographic printers where the means of toner application is a drum having charged surfaces over which dielectrically coated paper or film passes to generate a latent image or (b) electrostatic printers where the means of toner application is an array of nibs in a series of toning stations over which dielectrically coated paper or film passes to generate a latent image.

Consistency in color density in electrographic printing is important for minimizing plot to plot variability. Several variables influence the color density in electrographic printing, with the formulation of liquid toner being most important.

Conventional liquid toner comprises pigmented resin particles, isoparaffinic hydrocarbon carrier liquid (such as Isopar™), and charge control agent to affect electrical properties. Although pigment, resin, and charge control agent will each be present in the liquid toner, proper toning of the latent image occurs only when the toner particle is composed of all three components.

Only an effective range of toner formulation of appropriately charged, pigmented resin particles in liquid toner is considered a "viable" toner. A decrease in color density outside an acceptable range (also known as "depletion") commonly occurs when either: (a) the concentration of viable toner solids becomes too low; or (b) the conductivity of the working strength toner dispersion becomes too high.

The mechanism for weak image development caused by working strength conductivity is not well understood. For example, U.S. Pat. No. 5,278,615 (Landa) suggests that the conductivity of the toner becomes high enough that the charge on the paper is satisfied by "electrical leakage." U. S. Pat. No. 5,442,427 (Day) suggests that free floating charge control agent and charged, unpigmented resin particles compete with viable particles for charged sites on the paper, resulting in a lower image density. In addition, Day also suggests that, as the conductivity of the toner becomes higher, the viable solids become charged to a higher degree, and fewer of them are needed to satisfy the charge on the paper, resulting in lower image density.

Common replenishment schemes add toner concentrate (typically about 12–15% total solids) to the working strength toner (typically about 2–3% total solids), usually monitored by a feedback mechanism such as optical transmissivity.

Toner concentrate can be formulated with the proper relative concentrations of pigment, resin and charge control agent, but non-viable toner solids are always present in commercial toners.

During electrographic printing, viable toner solids are carried out of the printer system and onto the drum or toner station at a much higher rate than non-viable toner solids. Therefore, non-viable toner solids, comprising free charge control agent and charged, unpigmented resin particles, eventually build up to unacceptable levels, causing depletion as described above. At this point the toner is considered unreplenishable, and the entire fluid volume of the liquid toner must discarded.

Increasing the applied voltage during electrostatic imaging can increase image density, but can compensate for depleted toner only to a limited extent. Current replenishment schemes ultimately lead to depletion of the toner by either of the two methods discussed above, and a decrease in color density. Because a drop in color density can result in "cover over" by the next printed color, depletion is often accompanied by hue shift, compounding the problems caused by non-viable toner.

Several patents discuss liquid toner replenishment schemes for electrostatic or electrophotographic printing systems. U.S. Pat. No. 5,319,421 (West) and U.S. Pat. No. 4,222,497 (Lloyd et al.) teach replenishment of toner solids by measuring optical transmissivity of the liquid toner as it passes between two clear windows and relating this measurement to proper toner concentration. Toner concentrate is then added to the working strength toner based on these optical measurements.

U.S. Pat. No. 4,860,924 (Simms et al.) teaches the replenishment of toner based on measurement of working strength toner optical transmissivity and conductivity. Toner concentrate and charge control agent are added separately, and it is asserted that this method prevents the eventual depletion of the toner with repeated replenishment events. Also use of agitation to keep the toner concentrate from settling and the use of a motor-driven stirrer are disclosed.

U.S. Pat. No. 5,369,476 (Bowers et al.) teaches replenishment of toner based on measurement of the image quality. Also, the use of agitation to keep the toner concentrate from settling and the use of a recirculation pump are disclosed.

U.S. Pat. No. 5,155,001 (Landa et al.) teaches the use of a charge control agent that maintains proper concentration in the liquid toner by maintaining a solid-liquid phase equilibrium. A build up of charge agent with repeated replenishment events is avoided.

U.S. Pat. No. 5,442,427 (Day) teaches the use of agitation of toner concentrate which allows the use of concentrate with a lower concentration of charge control agent in the liquid toner formulation. The agitation keeps the concentrate suspended, and the decreased amount of charge control agent allows more replenishment events before the toner must be discarded because of high conductivity. Day and U.S. Pat. No. 5,404,210 (also Day) both disclose a means of recirculating toner through a purification apparatus that removes ionic contaminants from the toner. The purified toner is then added back to the system.

U.S. Pat. No. 5,623,715 (Clark) teaches (A) the use of continuous circulation of toner concentrate, in order to keep the particles from settling and allowing more precise addition of toner solids to the premix; (B) the use of a combination of a piston pump and check valves to precisely add toner concentrate; and (C) a calibration procedure for (B) whereby an analytical balance is used to weigh both imaged and non-imaged paper to determine the amount of toner solids applied to the paper, and calculate the concentrate replacement rate.

Several patents teach various mechanical means of removing depleted liquid toner from the development area in electrophotography. U.S. Pat. No. 3,913,524 (both Fukushima et al.) discuss passing a developed image and its adjacent layer of depleted toner through nip rolls in order to squeeze away the depleted toner. U.S. Pat. No. 4,623,241 (Buchan et al.) describes a slotted surface for removal of depleted toner from the development area. British Printed Specification 2179274-A (Spence-Bate) describes an apparatus that, combined with metering pumps, delivers a thin layer of liquid toner to the latent image in the exact amount used, so that excess toner need not be recirculated. In another embodiment, Spence-Bate also describes an alternative mode whereby excess toner can be drained away, and recirculated. Therefore, depleted toner that is not carried out with the image returns to the working strength toner reservoir, and it is not removed from the system.

These methods of eliminating depleted toner from the image surface and replacing it with fresh toner are essentially analogous to the toner applicator rollers used in multi-pass and single-pass electrostatic printers, such as those marketed by Raster Graphics of Sunnyvale, Calif, the ColorgrafX division of Xerox Corporation of San Jose, Calif, 3M Company of St. Paul, Minn, and N S Calcomp Corporation of Tokyo, Japan. Depleted toner is removed from the image surface, but is then mixed with the bulk of the working strength toner.

Several patents teach removal of liquid toner from electrographic printers in batchwise fashion. U.S. Pat. No. 5,396,316 (Smith) and U.S. Pat. No. 5,083,165 and U.S. Pat. No. 5,208,637 (both Landa) describe means of automating the step of discarding the depleted toner, by dispensing toner concentrate from a container or cartridge and removing excess depleted toner into the same container or cartridge.

SUMMARY OF INVENTION

Whatever the exact mechanism that is involved in poor color density, it is clear that a build up of "non-viable" toner solids and conductivity in electrographic liquid toners is to be avoided. This invention describes a change in the way replenishment is performed so that toner properties in the liquid toner are maintained at an acceptable and constant level. A benefit of the present invention is the ability to provide acceptable color densities for each of the four primary printing colors: cyan, magenta, yellow, and black ("CMYK" respectively) for print runs of one thousand square meters or more in length.

The present invention concerns maintenance of viable toner in electrographic toners during printing, by maintaining working strength solids and conductivity within ranges found to provide an acceptable range of color density as measured using a densitometer or colorimeter.

The present invention differs from the teachings of the Day patents in that liquid toner is not purified and reused. The present invention permits higher steady state concentrations of toner solids and charge control agents than disclosed by Day, whereby the present invention can use commercially available toners, without modification, and without constant agitation of the toner concentrate.

The present invention also solves a problem of build up of all contaminants in liquid toners, not just ionic species of non-viable toner solids.

This invention concerns a means to achieve substantially consistent printed color density by adding concentrate and, optionally, diluent to working strength toner substantially continuously and by removing a portion of the working strength toner substantially continuously in order to prevent build up of conductivity and non-viable toner solids in the liquid toner.

This invention also concerns a system for substantially maintaining color density in liquid toners for electrographic printers, comprising means for substantially continuously supplying toner concentrate and, optionally, diluent to a printer and means for substantially continuously withdrawing liquid toner from a printer into a waste flowstream.

None of the patents concerning liquid toner removal describe operating removal procedures substantially continuously.

A feature of the present invention is the ability to control color density of a toner by maintaining viable toner solids throughout usage of the liquid toner.

An advantage of the present invention is the efficiency and assurance of controlled color density of each liquid toner color, in order that longer duration printer usage and larger volume toner usage provide increased printer productivity.

Another advantage of the present invention is the use of waste removal rate that maximizes toner performance and minimizes toner waste. Thus, predetermined toner removal can produce less waste than waste created by batchwise replenishment schemes.

Other features and advantages of the present invention will be described in conjunction with the following drawings.

EMBODIMENTS OF INVENTION

Figure 1:
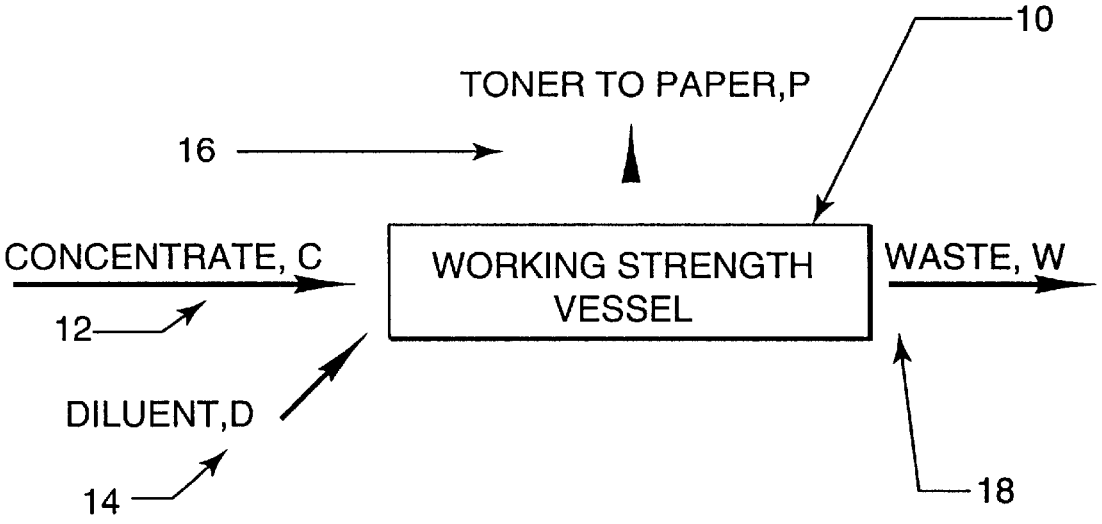
Fig. 1 is diagrammatic representation of flow of liquid toner through a printer according to the present invention.

FIG. 1 is a diagram of one embodiment of the present invention, showing the flow of liquid toner from concentrate in flowstream Q into a vessel 10 which contains an appropriate formulation of liquid toner, comprising toner solids (typically itself composed of pigment, binder, and charging agent), and isoparaffinic solvents.

In vessel 10, the appropriate formulation "working strength" of liquid toner can range from about 0.5 to about 10 weight percent toner solids, and from about 90 to about 99.5 weight percent solvent.

Commercially available toner concentrates of toner solids and charging agents are suitable for use in accordance with the present invention. Nonlimiting examples of suppliers of liquid toners for electrographic printers include: Scotchprint™Electrostatic Toners (3M, St. Paul, Minn); Raster Graphics Digital Inks (Raster Graphics, Sunnyvale, Calif); Versatec Premium Color toners, ColorGrafX HiBrite toners and ColorGrafX Turbo inks (all sold by Xerox, San Jose, Calif. or Rochester, N.Y.); and STC Weather Durable, STC High Saturation, and STC High Speed toners, all manufactured by Specialty Toner Corp of Fairfield, N.J. Likewise, commercially available hydrocarbon solvents are suitable for use in accordance with the present invention. Nonlimiting examples of hydrocarbon solvents include isoparaffinic solvents such as Isopar™G, Isopar L, Isopar M and Isopar C; and normal paraffins such as Norpar™12, all commercially available from Exxon Chemical Co. of Houston, Tex.; and mineral sprits, commercially available from, for example, Ashland Chemical Inc., of Columbus Ohio.

Commercially available toners can therefore be used without modification and without eventual depletion.

Desirably, the working strength of liquid toner can range from about 0.5 to about 10 weight percent toner solids (the balance being diluent).

Preferably, the working strength of liquid toner can range from about 1 to about 8 weight percent toner solids.

Vessel 10 has two entrance routes, 12, for toner concentrate, C, and 14 for optional diluent, D; and two exits for the liquid toner operating within working strength formulations. Exit 16 is a route in a flowstream, P, to a printer onto dielectric paper or film (from a drum or a toning station not shown). Exit 18 is to a route, W, to a waste container.

At steady state, percent solids and conductivity of the liquid toner in vessel 10 is substantially consistent during printer operation based on a substantially continuous flow of liquid toner in flowstream and a substantially continuous flow of liquid toner in flowstream W. During non-steady state operation, percent solids and conductivity of the liquid toner in vessel 10 may change, especially if the conductivity of the toner concentrate C, differs from that of the toner in vessel 10 when measured at the same percent solids.

The mass balance equations I and II describe one embodiment of maintaining substantially consistent working strength in vessel 10:

$$\text{total mass: } C=P+W \quad \text{(I)}$$

$$\text{total solids: } Cy_i=Px+Wy_o \quad \text{(II)}$$

where C is the flowstream of concentrate, D is the flowstream of diluent, P is the flowstream to printing, and W is the flowstream to waste; where x is the mass fraction of toner solids in flowstream P to the printer, and where $y_i$ and $y_o$ represent the mass fraction of toner solids in the flowstreams C and W, respectively, of toner concentrate and waste, respectively.

Alternatively, the invention allows for the addition of diluent, if needed, which can be described by the mass balance equations III and IV:

$$\text{total mass: } C+D=P+W \quad \text{(III)}$$

$$\text{total solids: } Cy_i+Dy_d=Px+Wy_o \quad \text{(IV)}$$

where C is the flowstream of concentrate, D is the flowstream of diluent, P is the flowstream to printing, and W is the flowstream to waste; where x is the mass fraction of toner solids in flowstream P to the printer, and where $y_i$, $y_o$, and $y_d$ represent the mass fraction of toner solids in the flowstreams C , W, and D respectively, of toner concentrate, waste and diluent, if any, respectively.

It should be noted that with no diluent, D, Equations III and IV devolve to Equations I and II, respectively, and, typically, no solids are present in diluent D.

It is evident from the mass balance equations (I–IV) above that concentrate C (and diluent D, if applicable) must be delivered at such a rate and with high enough solids fraction, $y_i$, so as to satisfy the need for the flow stream P and in particular the mass fraction of solids, x, being delivered to the printed graphic.

It is an important aspect of this invention that the rates C and D are maintained high enough so that W is a positive value, i.e., that the flowstreams C and D more than satisfy P (and x). It will be evident upon review of the examples below that the rate E and solids fraction x (and therefore the controllable rates C, D and W) are affected by the printer, the graphic being printed, the speed of printing, the toner chemistry (and in particular the toner color), and the conductivity of the working strength liquid. The mass fraction of solids in the concentrate y i and conductivity of the concentrate also necessarily affects the rate P.

Once total solids levels have reached a steady state level of working strength in vessel 10, color density will approach stability and remain within an acceptable range.

Acceptable color density ranges can vary from color to color, vary from toner to toner formulation, vary from printer to printer, and vary from media to media being toned. Variation can be adjusted using print voltages to bring each color into the density range. However, the present invention provides a system to maintain control of color density values for each of the colors.

For example for 3M Scotchprint™Electrostatic Toners for 3M Scotchprint™Electronic Imaging Media 8610 and for 3M Scotchprint™Electronic Transfer Media 8601 et seq. (at 50-55% R.H. and 21° C. on a Scotchprint™brand electrostatic printer), each of the primary printing colors has a minimum, target, and maximum color density value as follows in Table 1:

TABLE 1

| COLOR | MINIMUM | TARGET | MAXIMUM |
|---|---|---|---|
| Black | 1.35 | 1.45 | 1.50 |
| Yellow | 0.85 | 0.95 | 1.05 |
| Cyan | 1.25 | 1.35 | 1.40 |
| Magenta | 1.30 | 1.40 | 1.45 |

It is important for optimal printing to adjust three colors to reflect a variation of a fourth color from the target color density. For example, if yellow density is established at 0.99, then the other colors should also be adjusted to be 0.04 above their respective target density value.

Normally in the prior art methods, as toner is used, color density will decrease. Increasing print voltage will compensate for this loss up to the limits of the maximum available voltage or until spurious writing becomes unacceptable. Conventionally, to maintain color balance, each of the other colors must also be adjusted, making it quite difficult to maintain established color densities over any significant duration of electrography.

Unexpectedly, use of the present invention can provide minimal variance from those established and adjusted color density values during electrography by maintaining the flowstream C at such a rate so as to insure that flowstream W is positive.

The amounts of concentrated toner delivered in flowstream, C, is controlled by the print controller which can count the data assigned to each color. The amount of toner removed by printing flowstream, P, can be determined according to the ranges shown in Equation I–II or III–IV above, established through experimentation for various images and printers. One skilled in the art can modify the ranges according the particular needs of other printers now or hereafter developed.

For commercially available electrostatic printers, such as a Scotchprint™Model 2000 Electrostatic Printer from Minnesota Mining and Manufacturing Company of St. Paul, Minn. ("3M"), the present invention can provide unexpectedly superior consistent color densities within acceptable ranges that are substantially unvarying from established color densities relative to targets.

The amount of liquid toner removed to flowstream W can be a fixed ratio of the amount of toner concentrate added to flowstream C. Alternatively, W can be allowed to vary to account for changes in P and x that may result from changes in working strength conductivity or in the media type being printed. Either way, a substantially consistent level of charge, toner solids, and liquid toner in the electrographic printing system is maintained, thus assuring substantially consistent color density for each toner color in the printing system to which the present invention is applied.

In a preferred embodiment of the invention, controlled flow rates are: C, determined for a particular concentrate (color, % solids, and conductivity) and flow rate D, determined by the particular graphic, D being highest for lightly toned images; and W is allowed to vary according to changes in P as described above. Flow rates C (and D) can be shown to affect color density (see examples). Too high a rate of C results in overconcentration of the working strength toner (high percent solids and high conductivity), resulting in low color density of the image. Too low a rate of C or too high a rate of D results in underconcentration of the working strength toner (low percent solids and low color density of the image). The use of concentrate that has a lower conductivity than the working strength toner can be used to allow for some amount of overconcentration.

Figure 2:
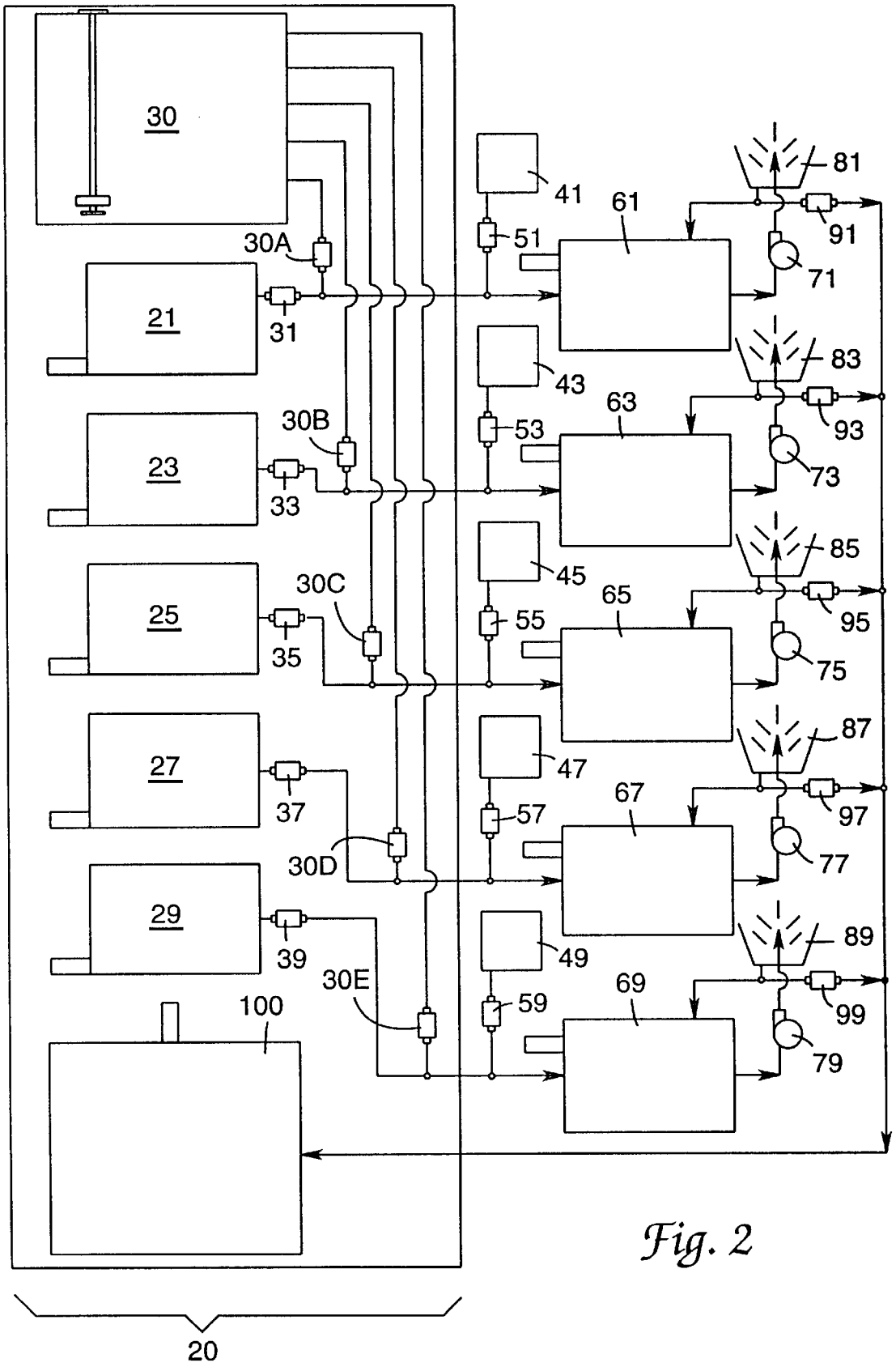
FIG. 2 is a diagrammatic representation of flow of liquid toners of several colors through a printer according to the present invention.

FIG. 2 shows the present invention applied to a four-color printing system, such as a Scotchprint™Model 9510, 9512, or 2000 electrostatic printer commercially available from 3M. However, any number of color toning stations in a printer can benefit from the present invention, especially such as a Scotchprint™2000 electrostatic printer that has an optional fifth toning station.

Toner module 20 comprises 5 storage containers 21, 23, 25, 27, and 29 for the four colors of black, yellow, cyan, and magenta in solids content of about 12% and optional fifth stationtoner, respectively.Further, diluent 30 is stored in container 30. The storage containers can be of any volume, but typically can be about 5 liters in volume to minimize the number of bottle changes required during printing.

Metering pumps 31, 33, 35, 37, and 39 are associated with each toner storage container, respectively. A metering pump for addition of diluent from container 30 is provided for each of the toners, respectively, 30A–30E. These pumps 31–39 control the rate of flowstream C for concentrates, and pumps 40A–40E control the rate of flowstream D for diluent, as needed.

Concentrate vessels 41, 43, 45, 47, and 49 with associated pumps 51, 53, 55, 57, and 59, respectively, exist in the printer and provide concentrate when toner module 20 is not in use. Mixing vessels 61, 63, 65, 67, and 69, respectively, accumulate the toner concentrates for each color and diluent which are then pumped using conventional toner pumps 71, 73, 75, 77, and 79, respectively, to conventional developing apparatus such as a drum or toning station (shown here as 81, 83, 85, 87, and 89, respectively). Conventional liquid toner gathering equipment and tubing, returns unused liquid toner to each mixing vessel 61-69, respectively.

Prior to return to each accumulator, each color liquid toner can enter tubing connected to pumps 91, 93, 95, 97, and 99, respectively, which are in turn connected a common waste vessel 100. These pumps 91-99 control the rate of waste flowstream W to common waste vessel 100 for disposal. In the alternative, a separate waste vessel can exist for each color and permit further processing, if possible, of the waste flowstream W for each color.

Other flow diagrams are possible within the scope of the present invention. For example, control valves can be used in place of pump assemblies for the diluent. Further, one could mix diluent and concentrate at other locations in the feedstream including at vessel 10 as seen in FIG. I or in vessels 61–69, respectively, in FIG. 2.

Further embodiments and variations are indicated in the following examples.

EXAMPLE 1

Part A (Closed System)

Scotchprint™Electrostatic black liquid toner having 2% toner solids and 98% diluent was used. Liquid toner usage rate, P, and mass fraction solids, x, were determined for a Scotchprint™2000 electrostatic printer, printing at 3.05 m/min with the standard toner concentrate add system disabled for a solid black image. Media for all examples was Scotchprint™Electrostatic Imaging Paper 8610. No concentrate was added and no toner was removed during this part of the experiment. Therefore, the only toner removed was by printing. Flowstream P's rate was about 9 g/imin. and was calculated simply by weighing the bottle of working strength liquid toner before and after the test and dividing by the run time.

The toner solids concentration was measured at the beginning of the test (using freshly mixed toner) and again at the end of the test—when the density of the image fell below an acceptable value. Using mass balance calculations, the mass fraction of solids removed, x, was determined to be 0.33

Equations I and II were applied (because no diluent was used), using the above values for and x and the following values:

$y_i$=0.12 (12% concentrate), and $y_o$=0.022 (maintaining the solids slightly elevated above the initial 2% solids level), The equations I and II were solved simultaneously for C and W to obtain C=28.3 g/riin and W=19.3 g/min.

EXAMPLE 1

Part B (Open System)

The values of C and W obtained from the Closed System Part A above were then used to confirm the utility of the present invention. In this open system test, concentrate with a conductivity of 120 pMho/cm (measured at 2% solids and using a Scientifica Model 627 conductivity meter from Scientifica Instruments of Princeton, N.J., USA) and 12% solids concentration was used.

A solid black image was printed, for about 1000 square meters, while regularly monitoring all flow rates, the working strength toner conductivity and percent solids, and the color density of the image being printed. At the end of the test, color density of the image had dropped by only 0.04 density units, from 1.48 to 1.44, a very small drop considering the area of image printed (see Table 2 below). Observed flow rates and final concentrations varied only slightly from the values of the Closed System Part A of Example 1.

For example, concentrate, C was added at 28.5 g/min instead of 28.3 g/min, percent solids of the working strength were 2.3%, not 2.2% and waste stream, W was 21 g/min not 19.3 g/min, the observed rate for was 8 not 9 g/min.

The total amount of waste accumulated for this test was 5040 g, or approximately 5 g/m$^2$ of graphic area printed.

EXAMPLE 2 (COMPARATIVE)

The Open System test in Example 1, Part B was repeated, except that concentrate, C was added at a somewhat lower rate of 27 g/min. All other controlled variables were held constant. A solid black image was printed for 250 square meters and the test was stopped because the image density had dropped from 1.48 to 1.28, an unacceptable level. Percent solids of the working strength was 1.0% and the observed waste flow rate was 18 g/min. (see Table 2 below). The total amount of waste accumulated for this test was 1080 g, or approximately 4.3 g/m$^2$.

EXAMPLE 3

A Closed System test was performed as in Part A of Example 1, only using magenta toner and a solid magenta image. Values for P and x were determined experimentally to be 13 and 0.3, respectively. Solving equations I and II simultaneously for C and W yielded 36.9 and 23.9 g/min, respectively.

An Open System test was performed substantially as in Example 1, Part B, using magenta concentrate with a conductivity of 14 pMho/cm (measured at 2% solids) and 12% solids concentration was added at a rate of 36 g/min. A solid magenta image was printed, for 837 square meters, while regularly monitoring all flow rates, the working strength toner conductivity and percent solids, and the color density of the image being printed.

At the end of the test, color density of the image had varied by 0.07 density units, from 1.30 to 1.37, a small but acceptable increase. Observed flow rates and final concentrations varied somewhat from the values calculated in the closed system test: percent solids of the working strength were 3.4%, not 2.2% and waste stream, W was 25 g/min not 24 g/min, the observed rate for P was 11 not 13 g/min. The higher percentage of solids in the working strength toner at the end of the test may reflect a lower amount of viable toner solids in the magenta toner here compared to the black toner used in Example 1. The total amount of waste accumulated for this test was 5000 g, or approximately 6 g/m$^2$.

EXAMPLE 4

Example 3 was repeated using a higher concentrate add rate. Concentrate with a conductivity of 14 pMho/cm (measured at 2% solids) and 12% solids concentration was added at a rate of 49 g/min. A solid magenta image was printed, for 335 square meters, while regularly monitoring all flow rates, the working strength toner conductivity and percent solids, and the color density of the image being printed. At the end of the test, color density of the image had varied by only 0.06 density units, from 1.37 to 1.42, a small but acceptable increase.

As can be expected from increasing the concentrate add rate, observed flow rates and final concentrations varied somewhat from the values calculated in the Closed System test: percent solids of the working strength increased to 3.5% and waste stream, W increased to 31 g/min, the observed rate for P was 11 not 13 g/min. The higher percent solids in the working strength toner at the end of the test again may reflect a lower amount of viable toner solids in the toner compared to example 1. The total amount of waste accumulated for this test was 2480 g, or approximately 7.4 g/m$^2$. The increase in the waste/square meter shows that the flow rate was not optimal even though the present example resulted in acceptable values of color density.

EXAMPLE 5 (COMPARATIVE)

A Closed System test was performed as in Example 1, only using yellow toner and a solid yellow image. Values for P and x were determined experimentally to be 7 and 0.34, respectively. Solving equations I and II simultaneously for C and W yielded 22.7 and 15.7 g/min, respectively.

An Open System test was performed as in Example 1. Concentrate with a conductivity of 233 pMho/cm (measured at 2% solids) and 12% solids concentration was added in a test of the present invention at a rate of 21.6 g/min. A solid yellow image was printed, for 1000 square meters, while regularly monitoring all flow rates, the working strength toner conductivity and percent solids, and the color density of the image being printed.

At the end of the test, color density of the image had dropped by 0.13 density units, from 1.03 to 0.90, which was accompanied by cyan cover over. "Cyan cover over" means an inadequate charge satisfaction on the print media with compensation provided by the next color in the printer, in this case, cyan. The cyan toner bath fulfilled what the yellow toner was unable to fulfill.

Observed flow rates and final concentrations varied somewhat from the values calculated in the Closed System test: percent solids of the working strength were 3.1%, not 2.2% and waste stream, W was 15 g/min not 15.7 g/min, the observed rate for P was 6.6 not 7 g/min. The higher percentage of solids in the working strength toner at the end of the test may reflect a lower amount of viable toner solids in the yellow toner here compared with the black toner of Example 1. The total amount of waste accumulated for this test was 3600 g, or approximately 3.6 g/m$^2$.

EXAMPLE 6

Example 5 was repeated except that the concentrate add rate was increased to compensate for the low conductivity of the working strength toner at the end of the test in example 5. In an Open System test, concentrate with a conductivity of 217 pMho/cm (measured at 2% solids) and 12% solids concentration was added at a rate of 23.3 g/min. A solid yellow image was printed, for 1172 square meters, while regularly monitoring all flow rates, the working strength toner conductivity and percent solids, and the color density of the image being printed.

At the end of the test, color density of the image had dropped by only 0.04 density units, from 0.99 to 0.95, a truly excellent result considering the usage of almost 7 rolls of electrostatic paper of about 120 linear meters each, printing a constant color over the entire printing surface of the media. As could be expected from increasing the concentrate flow rate, percent solids of the working strength increased from Example 5 to 3.3%, and waste stream, W increased to 17.3 g/min. The observed rate for P was 6 not 7 g/min. The higher percentage of solids in the working strength toner at the end of the test again probably reflects a lower amount of viable toner solids in the toner compared to example 1. The total amount of waste accumulated for this test was 4844 g, or approximately 4.1 g/m$^2$ .

EXAMPLE 7

A Closed System test was performed as in Example 1, only using cyan toner and a solid cyan image. Values for P and x were determined experimentally to be 9 and 0.2, respectively. Solving equations I and II simultaneously for C and W yielded 16.3 and 7.3 g/min, respectively.

In an Open System test, concentrate with a conductivity of 96 pMho/cm (measured at 2% solids) and 12% solids concentration was at a rate of 16.1 g/min. A solid cyan image was printed, for 1000 square meters, while regularly monitoring all flow rates, the working strength toner conductivity and percent solids, and the color density of the image being printed.

At the end of the test, color density of the image had decreased by only 0.08 density units, from 1.41 to 1.33, again a truly unexpected yield of consistent color density for a large area. Observed flow rates and final concentrations varied slightly from the values calculated in the Closed System test: percent solids of the working strength was 2.9%, not 2.2% and waste stream, W was 7.8 g imin not 7.3 g imin, the observed rate for P was 8.3 not 9 g/min. The somewhat higher percentage of solids in the working strength toner at the end of the test may reflect a lower amount of viable toner solids in the cyan toner here compared with the black toner of Example 1. The total amount of waste accumulated for this test was 1872 g, or approximately 1.9 g/m$^2$.

EXAMPLE 8

This example demonstrates the use of the present invention on a printer other than used in the previous examples. In a Closed System test like Example 1, liquid toner usage rate, P, and mass fraction solids, x, were determined for a Scotchprint™9512 electrostatic printer, printing at 0.76 m/min with standard Scotchprint™Electrostatic magenta toner. The standard toner concentrate add system was disabled. As in the Example 1, no concentrate was added and no toner was removed during this part of the experiment, except by printing. P and x were determined for a solid magenta image to be 1.6 g/min and 0.26 respectively. Equations I and II were applied (no diluent was used), using the above values for P and x and using the following values:

$y_i$=0.1125, and $y_o$=0.011

The above values were selected to account for a viable toner/total toner solids ratio of about 0.75 for concentrate having a concentration of 15% (0.15×0.75=0.1125). The equations when solved predicted C and W on a viable toner solids basis, and did not predict what the total solids would be. The equations were solved simultaneously for C and W to obtain C=3.9 g/min and W=2.3.

In an analogous Open System test like Example 1, concentrate with a conductivity of 80 pMho/cm (measured at 2% solids) and 15% solids concentration was used. A solid magenta image was printed, for 2100 square meters, while regularly monitoring all flow rates, the working strength toner conductivity and percent solids, and the color density of the image being printed. At the end of the test, color density of the image had dropped by only 0.09 density units, from 1.45 to 1.36, a very small drop considering the area of image printed (see Table 2 below). In this test, flow rates C and W were controlled by metering pumps and held constant. Total solids concentration increased considerably, measured at the end of the test at 7.6%. Conductivity did not appreciably increase, however, perhaps indicating that most of the solids in the toner were non-viable (no analysis was performed, however). The total amount of waste accumulated for this test was 5040 g, or approximately 5 g/m$^2$.

To affirm the unexpectedness of the present invention, Examples 1–8 (Open System) are summarized below.

TABLE 2

Open System Summary Results

| | | | Concentrate | | C | D | W | P | Color Density | | Print Area | Working Strength pMho/cm | | Working Strength $y_o$ | | |
|---|---|---|---|---|---|---|---|---|---|---|---|---|---|---|---|---|
| Ex. | Printer | Image | $y_i$ | pMho/cm | g/min | g/min | g/min | g/min | Begin | End | m$^2$ | Begin | End | Begin | End | Comments |
| 1 | SP2000 | solidK | 0.12 | 120 | 28.5 | 0 | 20.5 | 8 | 1.481 | 1.442 | 1004.4 | 190 | 100 | 0.02 | 0.023 | excellent stability |
| C-2 | SP2000 | solidK | 0.12 | 120 | 27 | 0 | 18 | 9 | 1.475 | 1.284 | 251.1 | 180 | 97 | 0.02 | 0.01 | add rate too low |
| 3 | SP2000 | solidM | 0.12 | 14 | 36 | 0 | 25 | 11 | 1.303 | 1.374 | 837 | 81 | 29/52 | 0.0196 | 0.034 | conductivity unstable |
| 4 | SP2000 | solidM | 0.12 | 14 | 49 | 0 | 31 | 18 | 1.366 | 1.424 | 334.8 | 87 | 19/64 | 0.0165 | 0.0348 | conductivity unstable |
| C-5 | SP2000 | solidY | 0.12 | 233 | 21.55 | 0 | 15 | 6.55 | 1.027 | 0.897 | 1004.4 | 303 | 206 | 0.0204 | 0.0308 | cyan coverover |
| 6 | SP2000 | solidY | 0.12 | 217 | 23.3 | 0 | 17.3 | 6 | 0.99 | 0.95 | 1172 | 326 | 308 | 0.021 | 0.033 | stable density |
| 7 | SP2000 | solidC | 0.12 | 96 | 16.1 | 0 | 7.8 | 8.3 | 1.411 | 1.329 | 1004.4 | 366 | 147 | 0.0231 | 0.0292 | fairly stable |
| 8 | 9512 | solidM | 0.15 | 80 | 3.9 | 0 | 2.3 | 1.6 | 1.45 | 1.36 | 2100.5 | 104 | 186 | 0.02 | 0.076 | excellent stability |

For the four successful examples shown in Table 2, there were many more unsuccessful experiments that occurred for a variety of reasons. Among the reasons for the unsuccessful experiments were failure of pumps during the experiments, low toner conductivity leading to image defects such as poor toner adhesion, over concentration of the toner resulting in low density due to high conductivity, concentrate settling, and toner foaming. However, using the disclosure of the present invention, one skilled in the art without undue experimentation can determine the proper values that solve Equations I and II above in a manner that provides essentially controllable and substantially unchanging color densities during extensive testing at the most extreme of conditions, namely, uninterrupted printing of solid color of cyan, magenta, yellow, or black. By providing one example of each color, one skilled in the art can determine the manner by which the present invention can solve the conventional problem of maintenance of color density of one color and the balances among different colors. Further, by listing some of our failed experiments as comparative examples, it is apparent that concentrate add rates in excess of the optimum add rate can lead to overconcentration of the working strength toner while concentrate add rates below the optimum can lead to underconcentration of the working strength toner. Also none of the examples includes the use of diluent because it is not necessary for graphics with a high percent fill; however, it becomes necessary for light fills so that the liquid level in the accumulator remains constant.

The invention may include various other ways to remove toner and excess conductivity from the system thereby maintaining substantially steady state levels of solids, conductivity, and color density. For example, pumps, siphons, wicking devices, moving porous belts, semi-permeable membranes,and the like could be used as contemplated in the present invention.

The invention is not limited the above embodiments. The claims follow.

What is claimed is:

1. A system for substantially maintaining color density in liquid toners for electrographic printers, comprising:

means for substantially continuously supplying toner concentrate to a printer and means for substantially continuously withdrawing liquid toner from a printer into a waste flowstream, wherein, the means for substantially continuously supplying and the means for substantially continuously withdrawing operate according to the equations $$C=P+W \quad \text{(I)}$$

$$Cy_i=Px+Wy_o \quad \text{(II)}$$

where C is the flowstream of concentrate, P is the flowstream to printing, and W is the flowstream to waste; where x is the mass fraction of toner solids in flowstream P to the printer, and where $y_i$ and $y_0$ represent the mass fraction of toner solids in the flowstreams C and W, respectively, of toner concentrate and waste, respectively.

2. The system of claim 1, wherein the electrographic printer is an electrostatic printer.

3. The system of claim 1, further comprising both said means for at least each of four primary printing colors: cyan, magenta, yellow, and black.

4. The system of claim 3, wherein both said means are used for each of four primary printing colors and a fifth station.

5. The system of claim 4, wherein both said means are used for each of four primary printing colors and a fifth station.

6. The system of claim 4, further comprising a single waste reservoir accumulating waste from each waste flowstream for each of at least the four primary colors.

7. The system of claim 4, further comprising a separate waste reservoir accumulating waste from each individual color waste flowstream.

8. The system of claim 3, further comprising a single waste reservoir accumulating waste from each waste flowstream for each of at least the four primary colors.

9. The system of claim 3, further comprising a separate waste reservoir accumulating waste from each individual color waste flowstream.

10. A system for substantially maintaining color density in liquid toners for electrographic printers, comprising:

means for substantially continuously supplying toner concentrate to a printer means for substantially continuously withdrawing liquid toner from a printer into a waste flowstream; and means for substantially continuously supplying diluent to a printer and wherein the means for substantially continuously supplying and the means for substantially continuously withdrawing operate according to the equations $$C+D=P+W \quad \text{(III)}$$

$$Cy_i+Dy_d=Px+Wy_o \quad \text{(IV)}$$

where C is the flowstream of concentrate, D is the flowstream of diluent, P is the flowstream to printing, and W is the flowstream to waste; where x is the mass fraction of toner solids in flowstream P to the printer, and where $y_i$, $y_o$, and $y_d$ represent the mass fraction of toner solids in the flowstreams C, W, and D respectively, of toner concentrate, waste and diluent, if any, respectively.

11. The system of claim 10, wherein the electrographic printer is an electrostatic printer.

12. A method to achieve substantially consistent color density of liquid toner in an electrographic printing system, comprising the steps of:

(a) adding toner concentrate to working strength liquid toner substantially continuously, and (b) removing a portion of the working strength liquid toner substantially continuously, wherein steps (a) and (b) operate according to the equations $$C=P+W \quad \text{(I)}$$

$$Cy_i=Px+Wy_o \quad \text{(II)}$$

where C is the flowstream of concentrate, P is the flowstream to printing, and W is the flowstream to waste; where x is the mass fraction of toner solids in flowstream P to the printer, and where $y_i$ and $y_o$ represent the mass fraction of toner solids in the flowstreams C and W, respectively, of toner concentrate and waste, respectively.

13. The process of claim 12, wherein the electrographic printer is an electrostatic printer.

14. A method to achieve substantially consistent color density of liquid toner in an electrographic printing system, comprising the steps of:

(a) adding toner concentrate to working strength liquid toner substantially continuously, (b) removing a portion of the working strength liquid toner substantially continuously, and (c) substantially continuously supplying diluent to a printer, and wherein the means for substantially continuously supplying and the means for substantially continuously withdrawing operate according to the equations $$C+D=P+W \quad \text{(III)}$$

$$Cy_i+Dy_d=Px+Wy_o \quad \text{(IV)}$$

where C is the flowstream of concentrate, D is the flowstream of diluent, P is the flowstream to printing, and W is the flowstream to waste; where x is the mass fraction of toner solids in flowstream P to the printer, and where $y_i$, $y_o$, and $y_d$ represent the mass fraction of toner solids in the flowstreams C , W, and D respectively, of toner concentrate, waste and diluent, if any, respectively.

15. The process of claim 12, wherein the electrographic printer is an electrostatic printer.

* * * * *